US005359259A

United States Patent [19]

Reidinger et al.

[11] Patent Number: 5,359,259

[45] Date of Patent: Oct. 25, 1994

[54] MASK-FRAME COMBINATION FOR A COLOR PICTURE TUBE

[75] Inventors: Rolf Reidinger, Ebersbach; Rolf Schmidt, Esslingen, both of Fed. Rep. of Germany

[73] Assignee: Nokia (Deutschland) GmbH, Pforzheim, Fed. Rep. of Germany

[21] Appl. No.: 897,862

[22] Filed: Jun. 12, 1992

[30] Foreign Application Priority Data

Jun. 13, 1991 [DE] Fed. Rep. of Germany ..... 4119481

[51] Int. Cl.[5] ..... H01J 29/07

[52] U.S. Cl. ..... 313/407; 313/408

[58] Field of Search ..... 313/402, 407, 408, 404, 313/403

[56] References Cited

U.S. PATENT DOCUMENTS 3,516,147 6/1970 Seedorff et al. ..... 313/407
4,806,820 2/1989 Berner et al. ..... 313/404
5,218,265 6/1993 Reidinger et al. ..... 313/407

FOREIGN PATENT DOCUMENTS 3115797 5/1985 Fed. Rep. of Germany ..... H01J 29/07

*Primary Examiner*—Donald J. Yusko
*Assistant Examiner*—Ashok Patel
*Attorney, Agent, or Firm*—Ware, Fressola, Van Der Sluys & Adolphson

[57] ABSTRACT

A mask-frame combination for a color picture tube includes a metal mask (12) placed over the frame with a skirting that overhangs the frame with an overhang height (H) and that is bent back toward the frame, and includes spot welds (15.1–15.12) located around the mask skirting for attaching the mask to the frame, wherein the mask skirting (13) bears against the outside of the frame (11) for attaching the mask where it is bent back, wherein the spot welds are arranged on each side of the long sides in such a manner that in each long side there is a central spot weld situated close to the mid-point of the long side and an outer spot weld on each side of the central spot weld and separated from the central spot weld by a distance of between D/14 and D/9, where D equals the length of the diagonal of the frame, and wherein the mask skirting is provided on each long side with openings (17) on two sides of each outer spot weld and adjacent thereto.

6 Claims, 2 Drawing Sheets

MASK-FRAME COMBINATION FOR A COLOR PICTURE TUBE

TECHNICAL FIELD

The present invention relates to a mask-frame combination for a colour picture tube, that is to say, an arrangement with a more or less rectangular frame and a mask that is joined to the frame by means of spot welding.

BACKGROUND OF THE INVENTION

Masks for colour picture tubes are drawn from special sheet metal sheets that are provided with elongated holes. A mask skirting is formed during the drawing and the mask is then made to bulge or arch. Given colour picture tubes with screen diagonals from about 50 cm upwards, the mask skirting is fixed to the frame by means of electric spot welding, using either twelve single spot welds or eight double spot welds as disclosed in German publication DE 3919674A1.

As regards the properties of the jointing between mask and frame, it is desirable for this to be characterized by great rigidity, so that the mask will neither become deformed as a result of impacts nor be excited into vibrations to any substantial extent by sound waves of the kind that will be transmitted by a loudspeaker arranged, for example, inside a television set. On the other hand, however, only a loose attachment is desired, especially in view of the different expansion behaviour of mask and frame during thermal processes employed in the manufacture of colour picture tubes and during the operation of such tubes, especially when substantial beam currents are involved.

With a view to satisfying these conflicting requirements in an optimal manner, it is usual for masks to be provided with stiffening beadings in particular positions, while decoupling slits are arranged elsewhere. Considerable attention must also be paid to the height of the spot weld in relation to the height of the mask. Such general problems and solutions therefor are described, among others, in DE 31 15 799 A1 (See U.S. Pat. No. 4,806,820).

A detailed solution of the problems discussed hereinabove is specified in DE 39 19 674 A1. The proposed solution involves the use of the previously mentioned eight double spot welds in place of the twelve single spot welds. When double spot welds are used, one such double spot weld will be situated in each of the four corners, while the remaining four will be arranged more or less at the mid-points of the four sides. When twelve single spot welds are used, there will be one such weld in each of the positions just described, while the remaining four will be arranged to the right and to the left of the central weld on the two long sides.

Geometric considerations indicate that longitudinal expansion of the mask is particularly critical as far as the proper functioning of a colour picture tube is concerned. Indeed, since the mask is only very slightly arched, changes in the length of the mask will have a considerably enhanced effect on the arching height of the mask. This, in turn, will lead to considerable displacements of the spatial position of the holes in the mask and thus causes shifts of the electron landing spots on the front trough of a colour picture tube. Since the said front trough is provided with a multitude of adjacent and tightly packed phosphor strips with different emission colours, such displacements of the spots struck by the electrons creates a situation in which the electrons no longer strike the particular phosphor strip for which they are really intended. Colours will therefore be falsified.

With a view to keeping these arching changes as small as possible, and therefore also the colour distortions caused by this phenomenon, it has become known to use masks made of invar. Mask-frame combinations with an invar mask are particularly easy to manufacture when the frame is likewise made of invar. However, since invar is several times as costly as steel, the frame of such invar combinations is usually designed as a relatively weak structural member. Notwithstanding this rather undesirable weakening of the frame, pure invar combinations are still considerably more expensive than a steel frame and a mask made of invar. Given combinations of the latter type, it is known for the mask not to be lapped over the frame, which is the usual method of manufacturing such combinations, but to choose the diameters of the mask in such a way as to make it fit into the interior of the frame. The spot welds will then join the mask skirting to the interior surface of the frame. But this calls for rather complicated and therefore failure-prone manufacturing devices, because the mask has to be held from inside and the spot welds have to be applied simultaneously, likewise from inside. By comparison, the devices used in the traditional manufacturing mode are far simpler, because the mask can be supported over a large area from inside, while the spot weld electrodes have free and unencumbered access from outside the frame.

On account of the above description of the problems associated with known mask-frame combinations consisting of a steel frame and an invar mask there existed a need to have these combinations designed in such a manner as to make their manufacture simpler than has hitherto been the case.

DESCRIPTION OF THE INVENTION

The mask-frame combination for a colour picture tube in accordance with the present invention comprises a steel frame and a mask made of a material with a small coefficient of thermal expansion, where the mask is so designed that

- the mask skirting bears against the outside of the frame,
- spot welds are arranged on each of the long sides in such a manner that in each case there is a central spot weld situated rather close to the mid-point of the long side and an outer spot weld on each side of the central spot weld and separated from it by a distance of between D/14 and D/9, where D=frame diameter along the diagonal, and that the mask skirting is provided with openings between the aforesaid spot welds and so situated as to be adjacent to the outer welds.

The combination as just described differs in two respects from the one known from DE 31 15 799 (see U.S. Pat. No. 4,806,820). Firstly, the two outer spot welds are situated closer to the central spot weld than to the welds in the corners, a condition that is not satisfied by the said known combination, because the distance from the central weld is there specified as between D/4.5 and D/2.4). Secondly, the mask skirting is provided with openings. Openings in the form of decoupling slots are known as such, from DE 39 19 674 for example. Such decoupling slots make it possible for the areas of the mask skirting around the spot welds to move with relative freedom. This effect is also produced by the openings in the combination according to the present invention, but in this case the slots also produce another effect that is of decisive importance for the proper functioning of the combination according to the invention. Indeed, the openings are not mere decoupling slots in the immediate vicinity of a spot weld, but extend in each case between two spot welds and are therefore adjacent also to the outer spot welds. This leads to a weakening of the mask skirting over the entire length of these openings. This weakening, together with the chosen location of the spot welds as previously described, ensures that the mask can undergo considerable elastic deformations in the area of the mask skirting during the cooling processes that the combination undergoes in manufacture, but without thereby producing any permanent deformations or sets.

Great additional advantages are obtained when the diameters of the mask are chosen so as to be greater than those of the frame and, more precisely, when the excess length is so chosen that, when the mask has a temperature just below the Curie point of its material and the temperature of the frame is either equal to the temperature of the mask or lies a few tens of degrees centigrade above it, the mask skirting will come to bear against the frame. In this way it can be ensured that the mask will not become distorted by the frame at any time during the manufacturing process, even though the frame itself may expand very considerably.

It is preferable for invar to be used in a known manner as the mask material with a small coefficient of thermal expansion. The thermal expansion coefficient of invar remains smaller than $10^{-6}$/°C. up to temperatures of about 60° C., while that of steel will be somewhat more than ten times as great. The Curie point of invar will lie more or less in the range between 200° and 240° C., depending on the particular composition of the invar used. Above the Curie point, on the other hand, the expansion of invar is substantially the same as that of steel, so that—given uniform heating of mask and frame—no further differential length changes will occur.

BEST MODE FOR CARRYING OUT THE INVENTION

Figure 1:
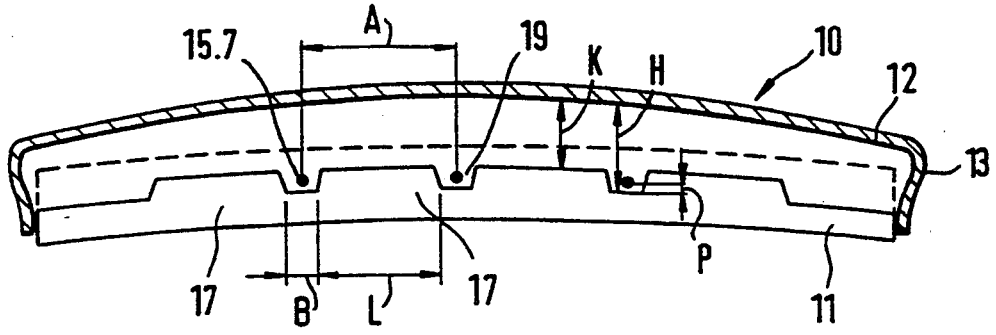
FIGS. 1 and 2 show, respectively, a side elevation and a top view of a mask-frame combination with openings in the mask skirting and spot welds in specially chosen areas of the long sides of the combination.
Figure 2:
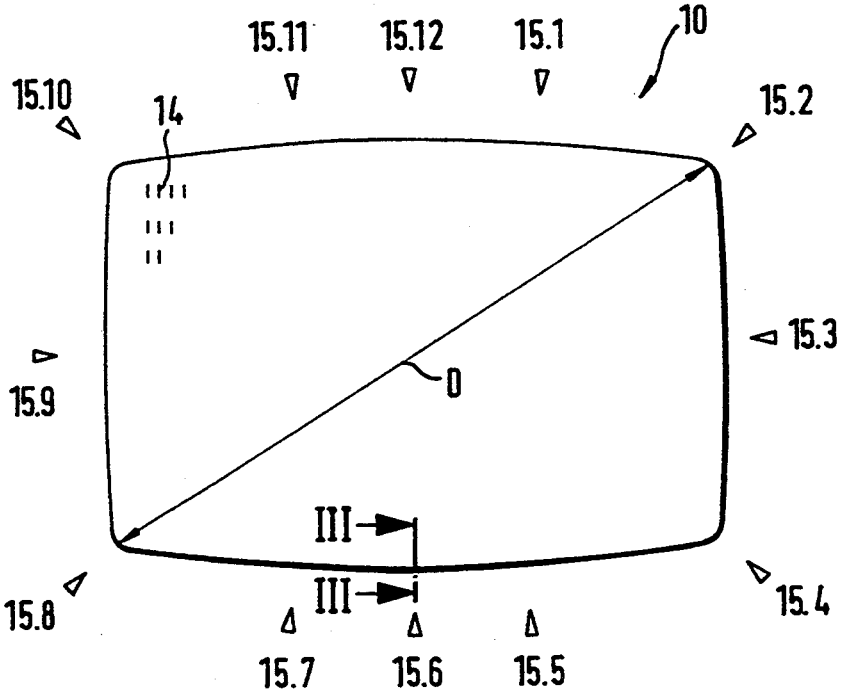

The mask-frame combination 10 for a colour picture tube shown in FIGS. 1 and 2 comprises a frame 11 and an arched mask 12 and a bent-back mask skirting 13. The mask 12 is provided with elongated holes 14 that permit electron beams to pass through them and, consequently, to excite the phosphors arranged in the form of strips on a front trough (not shown in the figures) and thus cause them to emit light. The mask skirting 13 is attached to the frame 11 by means of twelve spot welds 15.1 to 15.2, four of which (15.12, 15.4, 15.8 and 15.10) are situated at the corners of the combination, a further four (15.3, 15.6, 15.9 and 15.12) are to be found at the mid-point of the sides and will hereinafter be referred to as central spot welds, while the remaining four, are arranged—in two pairs (15.11 and 15.1, and 15.5 and 15.7)—to the left right of the respective central spot welds (15.12 and 15.6) on the long sides. These last four spot welds will henceforth be referred to as the outer spot welds.

A completely assembled mask-frame combination will comprise holding devices (not shown in the figures) fixed to the frame 11, the said devices serving to attach the combination 10 to the front trough of the picture tube. The attachment is obtained with the help of pins on the front trough that are situated roughly at the mid-points of the sides of the trough. The central spot welds 15.3, 15.6, 15.9 and 15.12 serve essentially to press the mask skirting 13 tightly against the frame 11 in the areas where these pins project from the bent-back edges of the front trough. Since the said pins, at least as a general rule, are not to be found at the exact mid-point of the side concerned, but will rather be displaced from this mid-point by a few millimetres, and sometimes even several tens of millimetres, the said central spot welds will likewise not be arranged at the exact mid-point of the given side of the frame, but will rather be displaced from that mid-point in keeping with the position of the pins.

Figure 3:
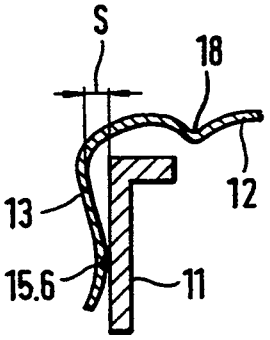
FIG. 3 hows a cross section along the line III—III of FIG. 2.

It can be seen from the partial cross section of FIG. 3 that the diameter of the mask 12 is slightly greater than that of the frame 11, so that there is some play S between mask and frame in the area where the mask is bent back. This play is so dimensioned that, given the most unfavourable longitudinal expansion conditions during manufacture, the mask skirting 13 will bear against the frame 11 with its entire surface and not only at the spot welds.

When a mask-frame combination is heated in a stabilizing oven or a calcar furnace during the manufacture of the colour picture tube, the combination being initially at room temperature, the frame 11, being made of steel, will at first expand relatively strongly, while the invar mask 12 will as yet hardly undergo any length changes at all. As from about 200° C. onwards, however, the coefficient of thermal expansion of the invar will also make itself felt and, from about 300° C. onwards, further temperature increases will lead to more or less the same expansion of mask and frame: the invar will then have passed its Curie point. As far as differential length changes are concerned, the problem area is therefore represented by the temperature range between room temperature and about 250° C. Conditions become particularly critical at the exit from a furnace, when the mask—having only a modest heat capacity—will cool very rapidly, while the frame is characterized by a substantially greater mass and its temperature will therefore diminish far more slowly.

The differential length changes that occur between room temperature and about 250° C. or vice versa are such as to bring with them the danger of causing permanent deformations of the mask. If this danger is to be effectively met, the structural rigidity of the mask must be weakened to the point where it will be able to compensate length differences due to thermal manufacturing processes by elastic deformations, but at the same time it must remain sufficiently stable to permit it to provide reliable resistance to mechanical stresses. The combination in accordance with FIGS. 1 and 2 satisfies these conflicting demands by means of the special position of the outer spot weld pairs 15.11, 15.1 and 15.5, 15.7, which are situated in the vicinity of the central spot welds 15.12 and 15.6 on the long sides, and the openings 17 in the mask skirting 13 between the spot welds and adjacent to the said outer spot welds. In a particular embodiment, the distance A between such an outer spot weld and its associated central spot weld amounted to D/11, where D is the length of the frame diagonal. Satisfactory manufacturing conditions were obtained when the said distance ranged between D/14 and D/9. It should be realized that the sizes of the openings 17 in relation to the frame are grossly exaggerated and not to scale. Each of the outer spot welds should lie as close as possible above the lower edge of the mask skirting 13. The distance P of the spot welds from the said lower edge amounted to 2 mm in the embodiment under consideration. The aforesaid openings are provided between the spot welds, so that webs or tabs 19 are formed in the vicinity of the spot welds. The width B of these webs 19 is such as to ensure that the connection between the mask 12 and the frame 11 remains mechanically stable. In the embodiment this width amounted to 9 mm. The distance between the spot welds, together with the width B of the webs 19, defines the lengths of the openings between two spot welds. The other openings adjacent to the outer spot welds 15.11, 15.1, 15.5 and 15.7, but situated on the outside of these spot welds, are given a similar length. Given a tube where the screen diagonal has a length of 71 cm, the length L will preferably lie in the range between about 40 and 60 mm. The depth of each opening 17 is so chosen that the height H of the mask skirting, which will typically be of the order of 12 mm, will be reduced to a height K of about 6 mm. If the mask is to be sufficiently flexible to enable it to yield elastically when subjected to the maximum length changes that occur during the manufacturing processes, it has been found that the reduced height K should not be greater than about 7 mm. When the reduced height K is made even smaller, the mask becomes even more elastic, but test masks with a reduced height of 5 mm or less showed that the mechanical stability needed to resist the action of external forces would be lost. With a view to increasing the stability of the mask, a circumferential stiffening beading 18 is provided along its edge, which corresponds to a measure that has been known for a long time. Subject to the use of customary invar masking material, the numerical examples quoted hereinabove were deduced for a 71 cm mask-frame combination. Correspondingly smaller dimensions apply in the case of smaller picture tubes. However, the structure as described herein is not suitable for arbitrarily small picture tubes. Rather, in the case of picture tubes of 50 cm or less, it will generally be more meaningful to have recourse to completely different structures.

Figure 4:
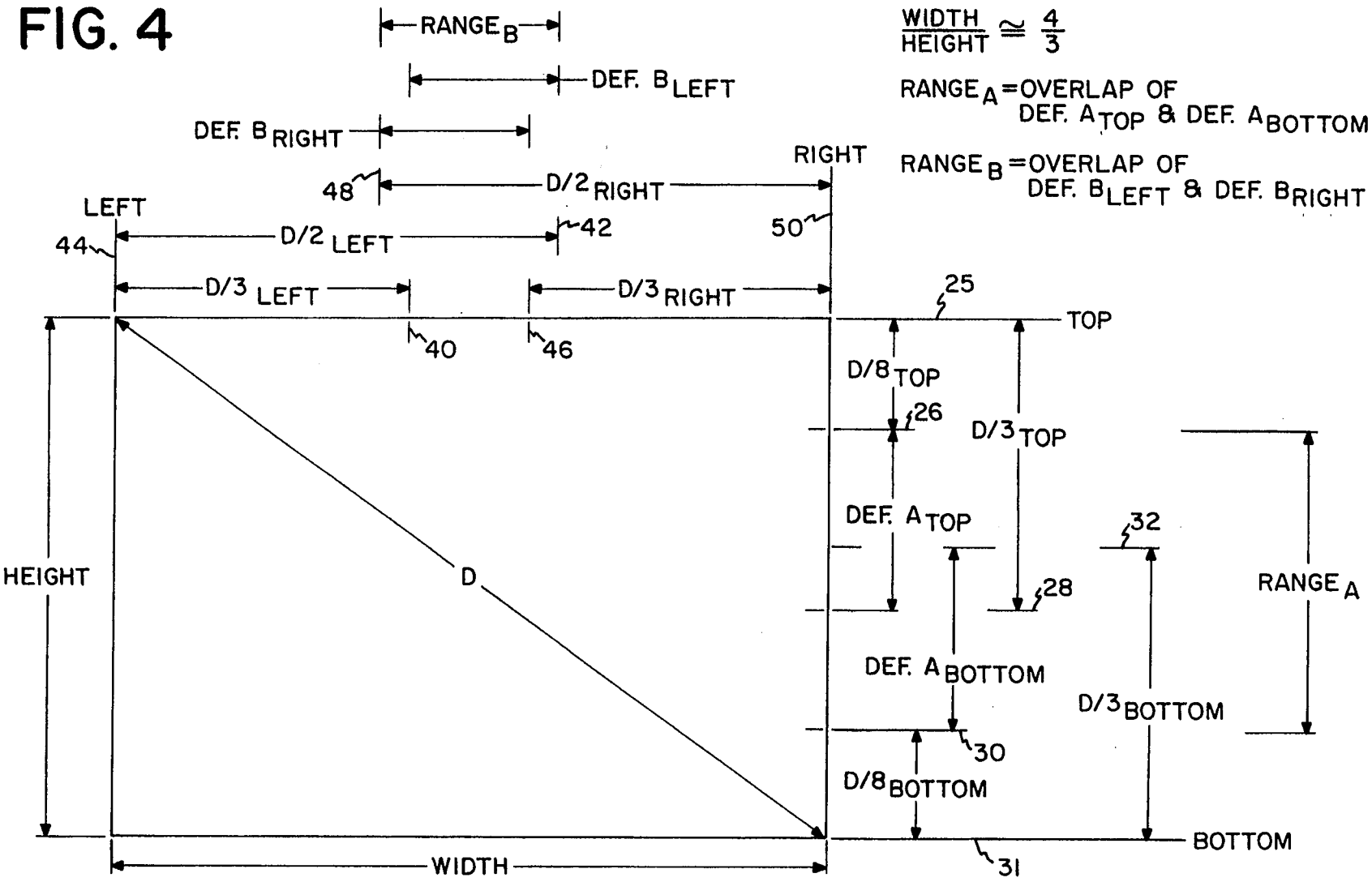
FIG. 4 is an illustration of the ranges within which the central spot welds may be placed.

In FIG. 4, a diagram is shown of a typical 4:3 aspect ratio television screen in which the width is four units wide and the height is three units high. According to the present invention, the central welds 15.6, 15.12 of FIGS. 1 and 2, should be positioned within the width $RANGE_B$. The welds 15.3 and 15.9 may be positioned within the height $RANGE_A$. The $RANGE_A$ is defined, along the height of the screen, as covering a range $DEF.A_{TOP}$ and a range $DEF.A_{BOTTOM}$. The $DEF.A_{TOP}$ and range is defined, as measured from a top edge 25, as falling between a line 26 which is a distance of D/8 from the line 25 and a line 28 falling a distance D/3 from the line 25, both measured vertically downwards from the top line 25. The range $DEF.A_{BOTTOM}$ is defined as falling between a line 30 being a distance D/8 from a line 31 at the bottom edge of the screen as measured vertically upwards therefrom, and a similarly measured line 32 at a distance D/3 from the bottom line 31.

The $RANGE_B$ along a long side covers a range $DEF.B_{LEFT}$ and a range $DEF.B_{RIGHT}$. The $DEF.B_{LEFT}$ range is defined as the range between a line 40 and a line 42 measured, respectively, at distances of D/3 and D/2 from a line 44 at the left vertical edge of the screen. Similarly, the range $DEF.B_{RIGHT}$ is defined as covering the range between a line 46 and a line 48 at distances D/3 and D/2, respectively, from a line 50 at the right vertical edge of the screen.

We claim:

1. A mask-frame combination for a color picture tube comprising:

a rectangular mask frame made of steel, a metal mask placed over the frame with a skirting that overhangs the frame with an overhang height and that is bent back toward the frame, and long side and short side spot welds located around the mask skirting for attaching the mask to the frame, wherein the mask skirting bears against the outside of the frame for attaching the mask where it is bent back, wherein the long side spot welds are arranged on each of the long sides in such a manner that in said each long side there is a central spot weld situated close to the mid-point of the long side and an outer spot weld on each side of the central spot weld and separated from the central spot weld by a distance of between D/14 and D/9, where D equals the length of the diagonal of the frame and is between about five hundred and seven hundred millimeters, and wherein the mask skirting is provided on each long side with openings on two sides of and adjacent to each outer spot weld, and wherein the short side spot welds are arranged on each of the short sides in such a manner that in said each short side there is a mid-point spot weld situated in the center or close to the center of the short side.

2. A mask-frame combination in accordance with claim 1, wherein the mask skirting has a reduced overhang height of not more than about 7 millimeters in the area of the openings.

3. A mask-frame combination in accordance with claim 1, wherein each spot weld (15.1 to 15.12) is arranged as close as possible to a free edge of the mask skirting (13).

4. A mask-frame combination in accordance with claim 1, wherein the diameter of the mask is greater than that of the frame so as to exceed the frame diameter by an amount such that the mask skirting will bear against the frame when the mask has a temperature just below its Curie point and the temperature of the frame is either equal to the temperature of the mask or lies a few tens of degrees centigrade above it.

5. The mask-frame combination of claim 1, wherein the central spot weld of each long side is located within a range as measured from either corner along its respective long side of between D/2 and D/3.

6. The mask-frame of claim 1, wherein the metal mask is made of Invar alloy.

* * * * *

UNITED STATES PATENT AND TRADEMARK OFFICE

CERTIFICATE OF CORRECTION

PATENT NO. : 5,359,259
DATED : October 25, 1994
INVENTOR(S) : Reidinger et al

It is certified that error appears in the above-indentified patent and that said Letters Patent is hereby corrected as shown below:

Title page item: [56], line 7, please change "3115797" to --3115799--.

Signed and Sealed this

Eighteenth Day of April, 1995

Bruce Lehman

*Attest:*

BRUCE LEHMAN

*Commissioner of Patents and Trademarks*

*Attesting Officer*